US007171787B2

(12) United States Patent
Thomason et al.

(10) Patent No.: US 7,171,787 B2
(45) Date of Patent: Feb. 6, 2007

(54) RECTANGULAR TILT-UP CONCRETE TANK CONSTRUCTION

(75) Inventors: David Thomason, Montgomery, AL (US); Mary Williams Goodson, Richmond, CA (US); Christian Carl Sundberg, Issaquah, WA (US); Michael Louis Doleac, Redmond, WA (US)

(73) Assignee: CH2M Hill Inc. FL (US)

( * ) Notice: Subject to any disclaimer, the term of this patent is extended or adjusted under 35 U.S.C. 154(b) by 294 days.

(21) Appl. No.: 10/606,172

(22) Filed: Jun. 24, 2003

(65) Prior Publication Data

US 2004/0261326 A1 Dec. 30, 2004

(51) Int. Cl.

| | |
|---|---|
| ***E04H 3/00*** | (2006.01) |
| ***E02D 27/38*** | (2006.01) |
| ***E04B 1/06*** | (2006.01) |
| ***E04B 1/343*** | (2006.01) |

(52) U.S. Cl. ..... 52/169.7; 52/223.2; 52/223.7; 52/293.3; 52/295

(58) Field of Classification Search ..... 52/79.1, 52/79.14, 740.1, 742.12, 155–165, 169.5, 52/223.1, 223.2, 223.6–223.14, 252–260, 52/293.3, 294, 295, 299, 302.1, 459–464, 52/19, 20, 169.7, 745.1, 745.11–745.13; 404/25; 249/188

See application file for complete search history.

(56) References Cited

U.S. PATENT DOCUMENTS

| | | | | |
|---|---|---|---|---|
| 903,909 | A | 11/1908 | Steiner | |
| 2,178,097 | A | 10/1939 | Davison et al. | |
| 2,587,724 | A * | 3/1952 | Henderson | 52/724.1 |
| 2,596,495 | A * | 5/1952 | Macerata | 264/228 |
| 2,971,295 | A * | 2/1961 | Orvel | 52/223.7 |
| 3,228,161 | A | 1/1966 | McCown | |
| 3,555,763 | A * | 1/1971 | Bloxom | 52/745.11 |
| 3,621,626 | A | 11/1971 | Tylius | |
| 3,640,038 | A | 2/1972 | Heron | |
| 3,812,637 | A * | 5/1974 | Yang et al. | 52/745.03 |
| 3,824,751 | A * | 7/1974 | Shelander | 52/223.3 |
| 4,015,383 | A | 4/1977 | Crowley | |
| 4,043,089 | A | 8/1977 | Bush et al. | |
| 4,282,690 | A * | 8/1981 | Meheen | 52/79.11 |
| 4,781,006 | A | 11/1988 | Haynes | |
| 4,819,394 | A | 4/1989 | Compton | |
| 4,865,213 | A * | 9/1989 | Kruger | 52/280 |
| 4,901,491 | A | 2/1990 | Phillips | |
| 4,961,293 | A | 10/1990 | House et al. | |

(Continued)

OTHER PUBLICATIONS

PCI Journal, Recommended Practice for Precast Prestressed Concrete Circular Storage Tanks.

*Primary Examiner*—Tamara L. Graysay
(74) *Attorney, Agent, or Firm*—Swanson & Bratschun LLC

(57) ABSTRACT

A rectangular tilt-up concrete tank includes a concrete slab with a metal plate anchored thereto, the metal plate defining at least one substantially linear concrete side wall location. A plurality of preformed concrete side panels each having metal plates attached along a bottom edge and opposing side edges are welded in a liquid-tight weld to the metal plate defining the concrete side wall location and a side metal plate of each side panel is welded to a metal side plate of an adjacent side panel in a liquid-tight weld to define a concrete side wall. Horizontal and vertical post-tensioning sleeves are provided in the side panels for receiving post-tensioning tendons.

13 Claims, 8 Drawing Sheets

U.S. PATENT DOCUMENTS 5,129,413 A 7/1992 Puder et al.
5,193,714 A 3/1993 Carey
5,201,786 A * 4/1993 Larsen ..... 52/223.7
5,507,124 A * 4/1996 Tadros et al. ..... 52/251
5,560,150 A * 10/1996 Pearson ..... 52/79.14
5,561,956 A 10/1996 Englekirk et al.
5,609,005 A 3/1997 Schierloh et al.
5,806,273 A 9/1998 Kaminski et al.
5,809,712 A * 9/1998 Simanjuntak ..... 52/223.7
5,865,001 A 2/1999 Martin et al.
5,881,519 A 3/1999 Newkirk
5,987,827 A 11/1999 Lord
6,009,677 A * 1/2000 Anderson ..... 52/251
6,067,757 A * 5/2000 Olson et al. ..... 52/125.1
6,131,365 A 10/2000 Crockett
6,282,853 B1 * 9/2001 Blaney et al. ..... 52/223.7
6,338,231 B1 1/2002 Enriquez
6,412,231 B1 * 7/2002 Palatin ..... 52/79.1
6,557,316 B2 * 5/2003 Van Der Heijden ..... 52/585.1

* cited by examiner

RECTANGULAR TILT-UP CONCRETE TANK CONSTRUCTION

TECHNICAL FIELD

The present invention relates to tank construction, and more particularly to a rectangular tilt-up concrete tank construction.

BACKGROUND ART

Conventional rectangular concrete tank construction makes extensive use of wood formwork to define vertical walls and steel reinforcing bars which extend from slabs and adjacent walls to facilitate the joining of walls to the slab or adjacent walls to each other. The use of conventional rectangular concrete tank construction has many drawbacks. First, conventional rectangular concrete tank construction creates extreme safety hazards for construction personnel. Extending reinforcing steel at best creates a tripping hazard and at worst an instrument for severe injury to workers. Conventional rectangular concrete tank construction often requires workers to climb reinforcing steel and formwork which are not intended to support construction personnel, creating a risk of falling. Furthermore, the use of cranes to "fly-in" reinforcing steel, formwork and concrete creates obvious overhead hazards. Moreover, the piece-meal nature of conventional rectangular concrete tank construction creates a myriad of other specific hazards associated with the necessary carpentry, concrete finishing, and reinforcement placement trades, including formwork clutter, extensive small tool usage, extension cords and cutting tools, to name but a few.

Second, the extensive use of wood formwork in conventional rectangular concrete tank construction also raises environmental issues. The amount of wood formwork wasted in the construction of a medium to large sized rectangular tank can equate to enough lumber to build several homes.

Third, conventional rectangular concrete tank construction techniques inherently create the potential for concrete defects such as misaligned concrete panels and concrete consolidation problems. Furthermore, water leakage problems associated with shrinkage, cracking, tie holes, water stop installation and the use of construction and expansion joints are commonplace.

Further problems with conventional rectangular concrete tank construction include high labor costs, high material costs and equipment usage costs and sequencing difficulties caused by the need to stagger concrete panel placements to prevent shrinkage cracking. Furthermore, efficient access to the construction site for workers and equipment is severely hampered by protruding reinforcing dowels. In addition, stripping formwork at the construction site can be hazardous because of protruding reinforcing. Moreover, curing of vertical concrete surfaces can be difficult and a substantial amount of finishing work may be required after the concrete has been poured.

The rectangular concrete tilt-up tank construction of the present invention is intended to overcome one or more of the problems discussed above.

SUMMARY OF THE INVENTION

A first aspect of the present invention is a rectangular concrete tank having a concrete slab with a metal, preferably steel, slab plate anchored thereto. The slab metal plate defines a substantially linear concrete side wall location of a rectangular wall outline. A plurality of preformed concrete side panels each have metal plates attached along a bottom edge and opposing side edges. The bottom plates are welded in a liquid-tight weld to the slab metal plate and at least one side metal plate of each side panel is welded to a metal side plate of an adjacent side panel in a liquid-tight weld to define a rectangular tank sidewall.

The rectangular tilt-up tank preferably also includes a number of slab metal plates anchored to the concrete slab define at least two adjacent substantially linear concrete side wall locations of the rectangular tank outline. A number of preformed concrete side panels each have metal plates attached along a bottom edge and opposing side edges. The bottom edge plates are welded in a liquid-tight weld to a slab metal plate defining a concrete side wall location and at least one side metal plate of each side panel is welded to a side metal plate of an adjacent side panel in a liquid tight weld to define at least two adjacent rectangular tank side walls. An L-shaped continuous metal corner brace is between adjacent side panel edges of adjacent tank sides. Each leg of the L-shaped continuous metal corner brace abuts an adjacent side panel edge and the adjacent side panel edges are welded in a liquid-tight weld to the abutting leg of the L-shaped continuous metal corner brace to define a liquid-tight rectangular tank corner. The L-shaped continuous metal corner brace preferably includes a diagonal gusset plate extending between a distal end of each leg of the L-shaped continuous metal corner brace. Preferably, a number of vertically spaced horizontal post-tensioning sleeves are provided within each preformed concrete side panel and are configured to define a plurality of continuous horizontal post-tensioning sleeves with adjacent side panels. The continuous post-tensioning sleeves receive post-tensioned tendons. The post-tensioned tendons may be anchored at the L-shaped continuous metal corner braces adjacent each tank side made of the side panels. Alternatively, a pulley attached to an L-shaped continuous metal corner brace can be provided between one or more pairs of adjacent tank sides with a sheave of the pulley receiving the post-tensioned cable to direct the cable between aligned continuous post-tensioning channels of adjacent tank sides. In addition, a number of horizontally spaced vertical post-tensioning sleeves may be provided within each preformed concrete side panel. The vertical post-tensioning sleeves are aligned with a corresponding number of post-tensioning anchors in the tank bottom slab. The vertical post-tensioning sleeves receive post-tensioned tendons that are connected to the post-tensioning anchors in the slab.

A second aspect of the invention is a method of making a rectangular concrete tank. The method includes forming a tank bottom from concrete and embedding metal plates in the concrete of the tank bottom in a rectangular configuration with the metal plates being essentially level with the surface of the concrete forming the tank bottom. A plurality of wall panels are formed, each having a metal plate along the length of a bottom edge and a metal plate along the length of each side edge. The wall panels are aligned along the rectangular configuration of the embedded metal plates with the metal plates of the bottom edges abutting the metal plates of the tank bottom and the metal plates of the side edges being in abutment with the metal plates of the side edges of adjacent wall panels. The metal plates of the bottom edges are joined to the embedded metal plates by a liquid-tight weld and the metal plates of the side edges are joined to abutting side edge metal plates by a liquid-tight weld. The method may further include horizontal and/or vertical post-tensioning the wall panel with post-tensioning tendons.

Yet another aspect of the present invention is an expansion joint for a concrete panel. The expansion joint consists of first and second adjacent concrete panel segments each disposed with an adjacent panel edge separated by a space. A continuous metal U-shaped channel is embedded lengthwise in each adjacent panel edge of the first and second panel segments on opposite sides of the space with a leg of each U-shaped channel having an unembedded surface and the unembedded surfaces being essentially coplanar. A sheet of flexible water-stop extends between the unembedded surfaces of the U-shaped channel and bridges the space. A clamp secures the water-stop to each unembedded surface of the U-shaped channel. A preformed joint filler may be provided in the space behind the water-stop. The expansion joint may further consist of separate clamps of a clamp pair securing the water-stop to each unembedded surface on opposite sides of the space. Each clamp consists of an L-shaped metal bracket having a first leg abutting the surface of the water-stop opposite the unembedded surface and a second leg extending from the first leg away from the unembedded surface and parallel to a second leg of the other clamp of the clamp pair to define a volume between the second legs. The first legs are fastened to the unembedded leg to secure the water-stop therebetween. A flexible sealant may be provided within the volume. Preferably, the unembedded surfaces reside within a recess in the concrete at a select depth and the second leg of each clamp leg extends a distance about equal to the select depth from the first leg, thereby defining a cavity above each first leg of the clamps, the cavity being filled with a grout. The grout is preferably a non-shrink grout.

Yet another aspect of the invention is a channel form assembly for a concrete tank slab including a form having substantially flat elongate bottom and a pair of diverging walls extending therefrom, the elongate bottom having a plurality of holes spaced along its length. A plurality of ground anchors having rods extending are anchored in ground underlying form work of the concrete tank slab with the rods extending upward and being received in a hole in the elongate bottom. A first stay is configured to engage the rod beneath the elongate bottom to suspend the elongate bottom above the ground a select distance and a second stay is configured to engage the rod above the elongate bottom, the second stay and the first stay clamping the elongate bottom therebetween. Preferably the rods are threaded and first and second stays comprise a nut and threadably engage the threaded rods. The walls may include flanges on their distal ends configured to support an elongate cover over an open top of the form.

The rectangular tilt-up concrete tank and method for making the same substantially reduces the safety hazards associated with conventional rectangular tank construction. Climbing of reinforcing steel and formwork is substantially eliminated, as is the flying in of materials via overhead cranes. Dangerous, protruding reinforcing at the slab and side panel construction joints is eliminated. Furthermore, the rectangular tilt-up concrete tank of the present invention requires little or no wood formwork. This eliminates a significant environmental deficiency associated with conventional rectangular tank construction. The liquid-tight welded joints of the present invention eliminate conventional construction joints and are relatively easy to make liquid-tight and to repair if leakage testing reveals defects. Many sources of concrete defects are also eliminated. For example, because the wall sections are formed while lying horizontal, they can be readily covered by plastic during curing to improve effective curing. Furthermore, potential defects such as misalignment and concrete consolidation are substantially reduced or eliminated. Finally, the rectangular tilt-up tank and method significantly reduces the intensive labor necessary to erect reinforcing and formwork and then strip the formwork. Most overhead work is also eliminated and numerous time consuming steps such as framing, stripping, water-stop placement, roughing of construction joints and finishing work are reduced or eliminated. Crane time, which is always a large expense on such a project, is also substantially reduced over conventional rectangular concrete tank construction.

DETAILED DESCRIPTION OF THE PREFERRED EMBODIMENT

Figure 1:
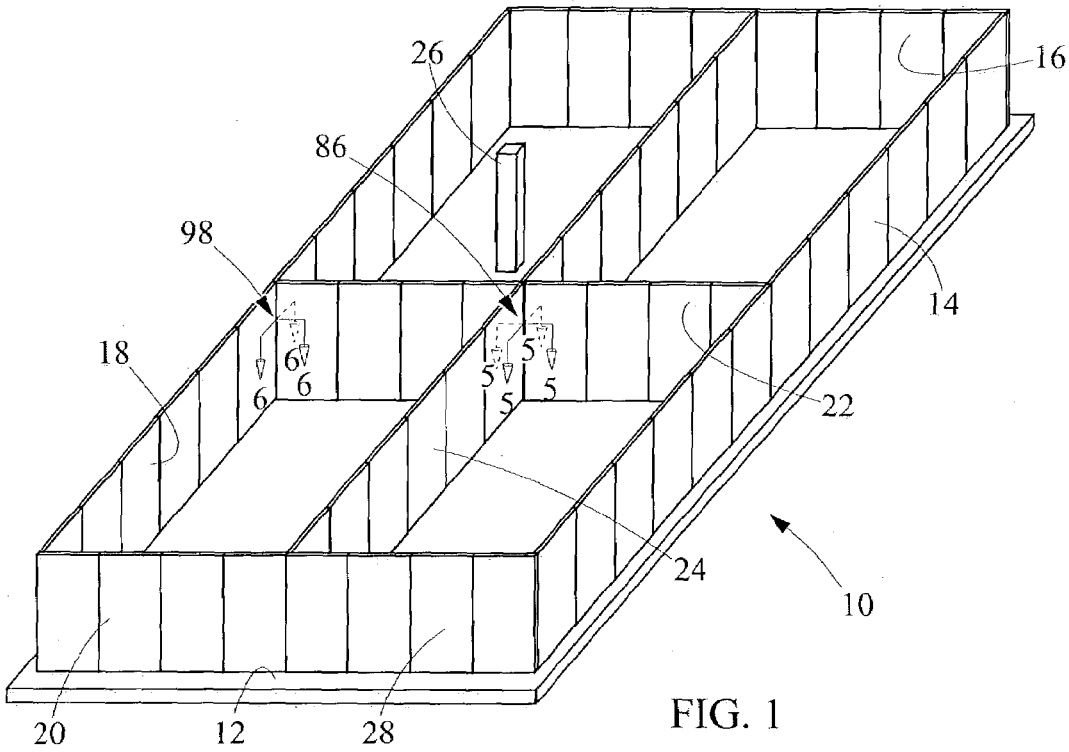
FIG. 1 is a perspective view of a rectangular concrete tilt-up tank without a top in accordance with the present invention.

A rectangular tilt-up concrete tank 10 is shown in a perspective view in FIG. 1. The rectangular tilt-up concrete tank 10 includes a concrete slab 12 and four side walls 14, 16, 18, 20 extending therefrom. Within a volume defined by the rectangular tilt-up concrete tank 10 one or more longitudinal dividing walls 24 and/or one or more transverse dividing walls 22 may be included to form compartments or direct flow. In addition, one or more columns 26 may be included within the tank to support a roof or other ancillary structures, which are not illustrated in FIG. 1 for the sake of clarity. Each of the side walls 14, 16, 18, 20 are made up of a number of preformed concrete side panels 28. At a minimum, the tilt-up concrete tank 10 consists of the bottom slab 12 and side walls 14, 16, 18, 20. The interior walls 22, 24, column 26 or a roof (not shown), as well as other interior structures, such as walkways and ladders, may be included as required by the purpose of the tank. In a manner that will be described in greater detail below, the preformed concrete side panels 28 have metal, preferably steel, plates along their bottom and side edges and steel plates are provided in a rectangular configuration in the concrete slab. The bottom concrete plate of each side panel is welded in a liquid-tight weld to the steel plate in the concrete slab and the steel side plates are welded to side steel plates of adjacent panels in a liquid-tight weld to define the tank.

Figure 2:
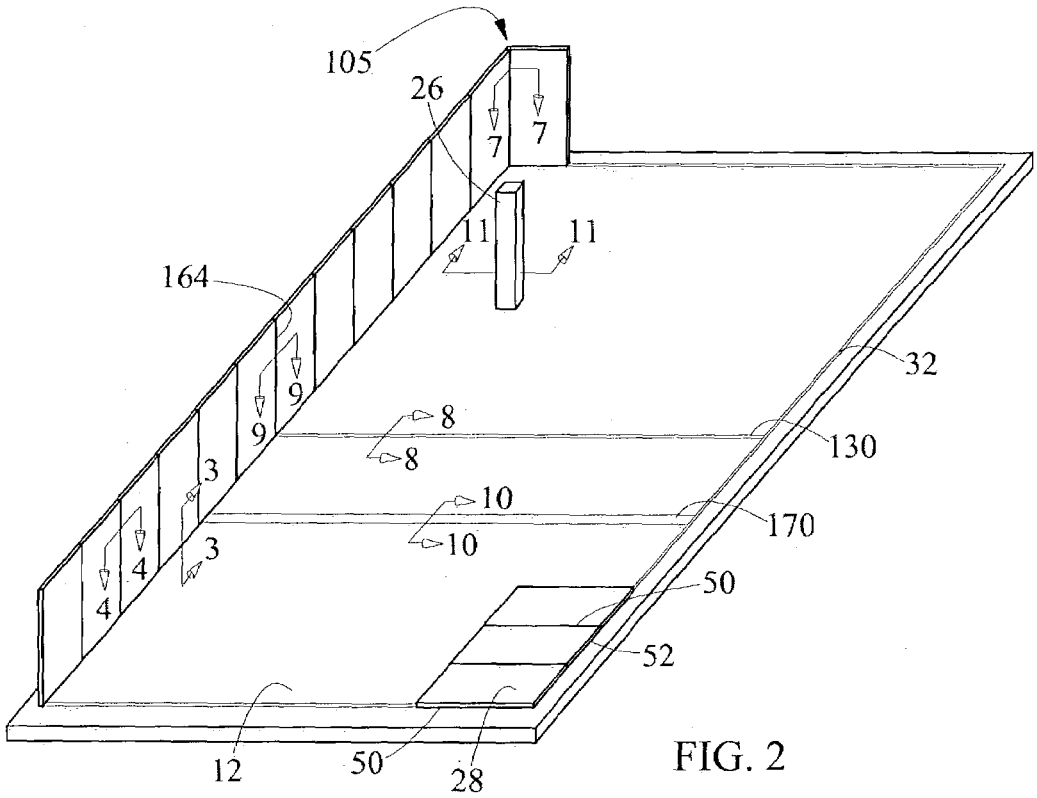
FIG. 2 is a perspective view of the rectangular concrete tilt-up tank of FIG. 1 under construction in accordance with the method of the present invention.
Figure 3:
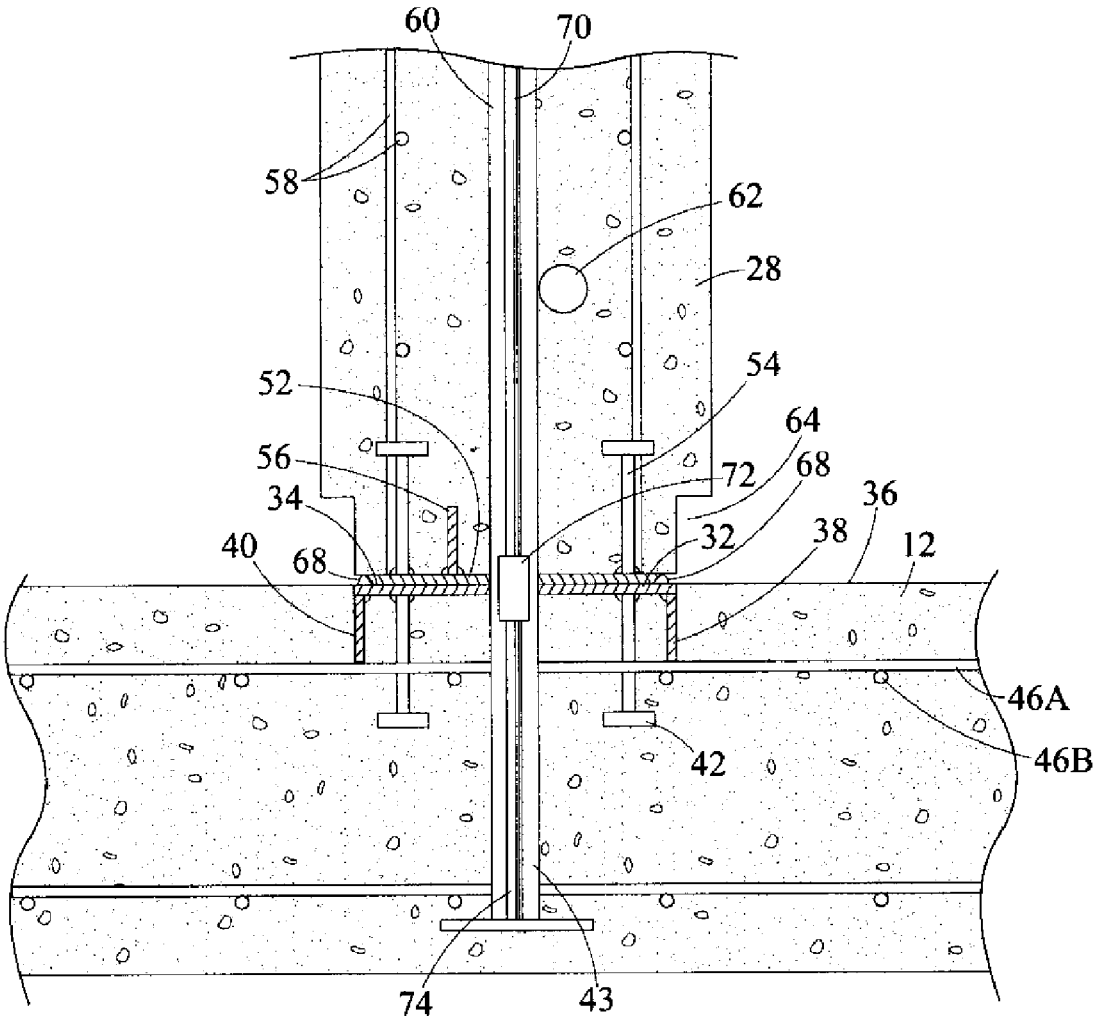
FIG. 3 is a cross-section of a wall/slab connection in taken along line 3—3 of FIG. 2.

FIG. 2 illustrates the rectangular tilt-up concrete tank 10 under construction in accordance with the method of the present invention. The concrete slab 12 has a number of continuous slab steel plates 32 anchored therein in a rectangular configuration defining a rectangular wall outline. Referring to FIG. 3, the slab steel plates 32 are preferably in the form of a steel channel embedded in the concrete slab 12 and include a top surface 34 which is substantially coplanar with a top surface 36 of the concrete slab. "Substantially coplanar" means abutting plates between the concrete slab and bottom of concrete side panels are readily accessible to welders or automated welding equipment and sufficiently parallel to the plane of the slab that side panels resting on the plates can be joined in water-tight seals using conventional welding techniques. Also, the plates should be sufficiently coplanar to allow easy movement of equipment on the slab during casting and erection of the wall panels. A pair of legs 38, 40 extend into the concrete slab 12 and function as water-stops and as supports from the reinforcing steel 46 for the slab steel plate 32 prior to casting the concrete slab 12. A number of headed anchor studs 42 are welded to an underside of the slab steel plate 32 and spaced lengthwise and widthwise to help anchor the slab steel plate within the concrete slab 12. The slab steel plates 32 are preferably a steel channel formed of rolled steel, welding of suitable plates or bent steel. Each plate can be formed of a single lengthwise piece or a number of lengthwise segments which are butt-welded end to end. Also at select locations along the slab steel plates 32 are provided vertical post-tensioning sleeves 43 anchored within the concrete slab 12. The vertical post-tensioning sleeves 43 align with holes defined in the slab steel plates as illustrated in FIG. 3. The slab 12 also includes conventional reinforcing steel or rebar 46 embedded therein.

Construction of the concrete slab 12 will begin with leveling and compaction of the base and subgrade and base materials which will be carefully controlled using motor graders and laser levels. Matt-type uniform thickness slabs are preferred for their ease of construction and for providing a flat surface for formation of the concrete side panels, as will be discussed in greater detail below. Slab edge forms will be put in place using laser lines and electronic distance measurement equipment. Expansion joints and wall lines are to be laid out and marked on the edge forms ensuring that all basin lines remain true. After edge form layout, reinforcing placement will begin. The reinforcing elevation is controlled using concrete blocks spaced throughout the subgrade which are precisely leveled. The reinforcing steel is spaced up off the subgrade from the concrete blocks using adjustable screw-type bolsters (similar to screed supports). During the slab reinforcing placement, vertical post-tensioning sleeves 43 are placed for anchoring within the concrete. Slab steel plates 32, which as described above, preferably consist of steel channels, are positioned so that they will be embedded substantially coplanar with the top surface of the concrete once it has been poured. The channels may be shop fabricated or they may be fabricated onsite from flat plate stock. Staggered holes will preferably be provided in the steel plates for insertion of concrete vibrators to ensure good concrete consolidation under the channels. Holes in the slab steel plates 32 are aligned with the vertical post-tensioning sleeves 43 and a post-tensioning coupling 72 will be provided near the finished concrete surface.

The slab steel plates 32 will be leveled and aligned with laser equipment and supported from the top layer of the reinforcing 46. Because the crossing bars in the top layer of reinforcing will be one bar-width different in elevation, the legs of the channels that would be supported from the lower bar 46B may be one bar-width longer than the legs of the channels supported from the upper bar 46A. To maintain horizontal alignment of the channels during concrete placement, short lengths of reinforcement bars may be securely tied in the top layer of reinforcing 46 under the channels and traverse the channels and the channel legs may be tack-welded to these bars. Welding will be to these added bars only, and not to the structural reinforcing. After all final adjustments, all channels will be welded together at the joints and intersections. In addition, as described below, fabricated metal expansion joint assembly components may be placed in the concrete slab formwork. These components also will be welded together at the joints and intersections. In addition, the top portion of these components will be welded to the slab channel legs 38, 40 where they intersect.

After all slab embeds have been set along wall lines and expansion joints, the slab will be poured. No wall dowels will protrude from the slab. This will facilitate access to the slab for personnel, for laser alignment and for pouring and finishing the concrete. Furthermore, this will enable much of the slab to be poured from trucks instead of overhead cranes or pumping equipment because access for concrete truck chutes will be improved and trucks may be driven onto previously completed slab sections to deliver concrete to subsequent sections. Because alignment tolerances in the wall panels will depend on slab tolerances, the slab should have a flat finish within about 0.25 inches. This should be achievable with screed pipes. Also, because there will be no protrusions from the slab, the use of automated screeding will be facilitated.

Figure 4A:
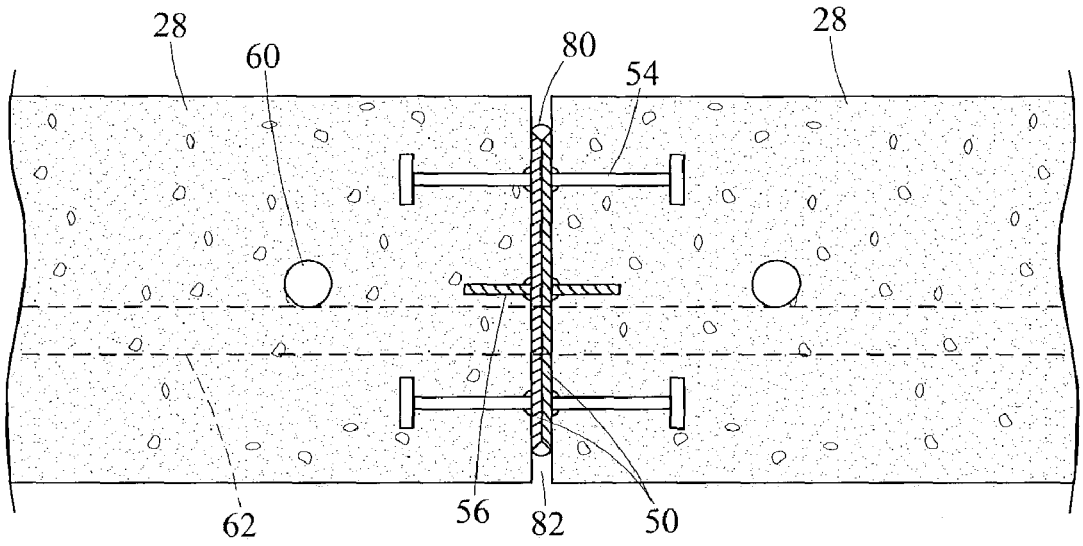
FIG. 4A is a cross-section of a wall/wall connection taken along line 4—4 of FIG. 2.

Referring to FIGS. 3 and 4A, each concrete side panel 28 has side steel plates 50 along each edge and a bottom steel plate 52. The bottom steel plate 52 and each of the side edge steel plates 50 are anchored within the concrete side panel 28 by a number of headed anchor studs 54 welded to an embedded side of the steel plates 50 and 52. A water-stop 56 consisting of an elongate steel sheet is also welded to the embedded side of the steel plates 50 and 52. Conventional rebar 58 is also embedded within the preformed concrete side panels 28. In addition, vertical post-tensioning sleeves 60 are provided and are configured to align with the vertical post-tensioning sleeves 43 in the bottom slab. A number of vertically spaced horizontal post-tensioning sleeves 62 are provided in each side panel 28 and are configured to define a plurality of continuous horizontal post-tensioning sleeves with adjacent side panels. Referring again to FIG. 3, adjacent the bottom steel plate 52 and running lengthwise of the preformed concrete side panels is a lengthwise void 64 which is defined in the preformed concrete side panel by the use of wooden strips or other material fastened to the edges of the bottom steel plate 52 when the side panel is poured.

FIG. 3 shows in detail a wall/slab connection in accordance with the present invention. The bottom steel plate 52 and the slab steel plates 32 are adjoined by lengthwise welds. The preformed concrete side panels 28 are further secured to the concrete slab 12 by vertical post-tensioning tendons 70 disposed within the vertical post-tensioning sleeves 60 of the preformed concrete side panels 28 which are coupled by a post-tensioning coupling 72 to a vertical post-tensioning anchor 74 embedded in the slab 12 and residing in part in the vertical post-tensioning sleeve 43. Note that although the post-tensioning anchor is depicted partially within a sleeve extending into the slab, a sleeve may not be needed in the slab, and the anchor may be directly embedded in the slab with only the coupling area being sleeved or blocked out to allow room for a connection to be made. Also note that a threaded coupling is depicted but that other types post tensioning couplings are commercially available and may be used. The term "post-tensioning tendon" as used herein can mean steel cables, steel rods, or other post-tensioning structures known in the art. With further reference to FIG. 3, it can be appreciated that the water-stop 56 will help maintain the water-tight integrity of the connection as will the legs 38, 40. Once the welds 68 are completed and water-tight testing is completed, grout is installed to fill the lengthwise voids 64 to protect the welds and adjacent steel surfaces from corrosion. The grout can be any number of suitable grouts, including epoxy-based or cement-based non-shrink grouts.

Each concrete side panel 28 may be formed on top of the concrete slab 12 as illustrated in FIG. 2. In a first step, a bond breaker will be spread over the affected slab lay-down area. A suitable bond breaker could be plastic sheeting or a chemical bond breaker. The wall panel formwork is then positioned on the slab surface and aligned with the slab steel plates 32. To form the wall panels, the side steel plates 50 and the bottom steel plates 52 along with the wood strips defining the lengthwise void 64 are aligned and serve as edge forms for three sides of the panel. The plates are fitted at their corners for later welding and overlapping "ears" may be provided to temporarily bolt them together until they are welded. On the top edge of the panel, a removable edge form is used.

Preferably, all the wall panels for a particular basin should be formed from a basin corner to a least one panel beyond a first expansion joint prior to pouring the concrete for any of the panel sections of that wall. This procedure will minimize the bracing needed on the edges of the panels to support concrete placement and will ensure proper alignment of all panels up to and including the expansion joint panels. Adjacent wall panels are formed with their sides in direct contact for match-casting the panels. This ensures the panels will remain square and true with respect to each other and will aid in aligning the vertical post-tensioning sleeves 60 and the horizontal post-tensioning sleeves 62. After positioning of all the panels through the expansion joint, the bottom interior corners of the panels between the bottom steel plate 52 and the side steel plates 50 are welded.

After the formwork is positioned, the reinforcing 58 is installed in each concrete side panel 28. The headed anchor studs may be positioned on the plates 50, 52 to act as guides for proper placement of the reinforcing within the formwork. In addition, the reinforcing may be fastened to some or all of the headed anchor studs 54 which will allow the reinforcing to double as form ties to resist deformation of the plates 50, 52 from pressure during concrete placement. This may allow the plate thickness to be minimized for economy. The first layer of reinforcing 58 will be spaced up off the slab with plastic chairs. After installation of the first reinforcing layer, the sleeves 60, 62 for vertical and horizontal post-tensioning are installed. The second layer of reinforcing is then installed. Firm spacers are preferably installed between the layers for positive spacing and to prevent the reinforcement from sagging and placing undue stress on the plates 50, 52.

The concrete is then placed in the formwork and finished with conventional mechanical screed equipment. A burnished surface can be achieved which will preclude the need for later finishing work or for exterior coatings. The wall sections may be poured essentially continuously until completion, because they are independent of one another and "staggering" of pours is not necessary. In addition, in many installations it would be possible for concrete trucks to drive out onto the slab allowing the wall panels to be poured directly from the truck instead of by crane and bucket or by pumping equipment.

After curing and strength gain, concrete side panels will be tilted up using a heavy lift crane. Prior to erecting the panels the embedded channels in the slab and the embedded plates in the wall panels are cleaned and rough welds are ground smooth. The panels are tilted up by using lift eyes embedded in lifting anchors previously installed. In one embodiment, vertical tendons are then inserted into the vertical post-tensioning sleeves 60 and the tendons mated with the vertical post-tensioning anchors 74 using the post-tensioning coupling 72. The concrete side panels 28 may be temporarily allowed to rest on blocking while the vertical tendons are being joined. After all the blocking has been removed, the bottom steel plates 52 will be carefully aligned with the slab steel plates 32 and the side steel plates will likewise be aligned in adjacent panel(s). Afterwards some or all of the vertical tendons will be stressed and locked to provide tension needed to hold the panel(s) in position. After the wall panels have been erected, they will be welded to each other and the and the embeds in the base and slab as discussed above. It should be noted that whether the vertical and/or horizontal tendons will first be tensioned and then welding will occur or whether welding will precede the post-tensioning may be determined by a variety of factors during tank construction. The horizontal and vertical post-tensioning sleeves may be pressure-grouted after tensioning to permanently anchor the tendons to the structure and to provide protection of the tendons against corrosion FIG. 4A illustrates a wall-to-wall connection in a cross-section taken along line 4—4 of FIG. 2. As seen in FIG. 4A, the side steel plates 50 each preferably have lengthwise beveled edges 80 which, when the side plates 50 are in abutment, define grooves within which a connection by weld can be made. The side steel plates 50 do not extend the entire width of the concrete side panels 28 so that a void 82 is defined adjacent the weld to receive an epoxy grout for protecting the weld and adjacent steel surfaces from corrosion. During forming, the voids 82 are defined by lengthwise forms such as wood strips when the concrete side panels 28 are poured. FIG. 4A also illustrates alignment of horizontal post-tensioning sleeves 62 in adjacent concrete side panels. This embodiment has the advantage of the concrete side panels being formed by "match casting", meaning that the side steel plates of adjacent concrete side panels act as abutting forms during formation of the concrete side panels to assure that they will be properly aligned for welding when erected.

Figure 4B:
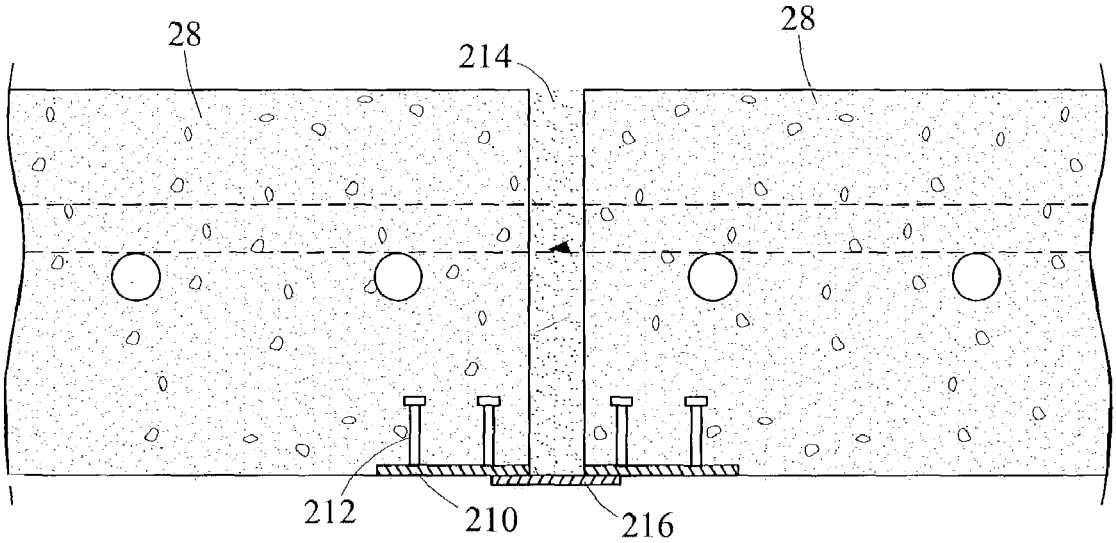
FIG. 4B is a cross-section of an alternate embodiment of a wall/wall connection taken along line 4—4 of FIG. 2.

FIG. 4B illustrates an alternate embodiment of a wall-to-wall connection in a cross-section taken along line 4—4 of FIG. 2. In this embodiment, steel plates 210 are embedded along side edges of the concrete side panels 28 in aligned surfaces of concrete side panels 28 by means of headed anchor studs 212. A space 214, on the order of a two inches in width, resides between adjacent side edges of the concrete side panels 28. The space 214 is preferably filled with grout. A bridge plate 216 bridges the space 214 and extends the height of the concrete side panels. The bridge plate 216 is part of a connection formed by water-tight welding of each steel plate 210 along its length to the bridge plate 216. This embodiment has the advantage of facilitating off-site formation of the concrete side panels 28 and providing ample tolerance for imperfections in the casting of the concrete side panels.

Figure 5:
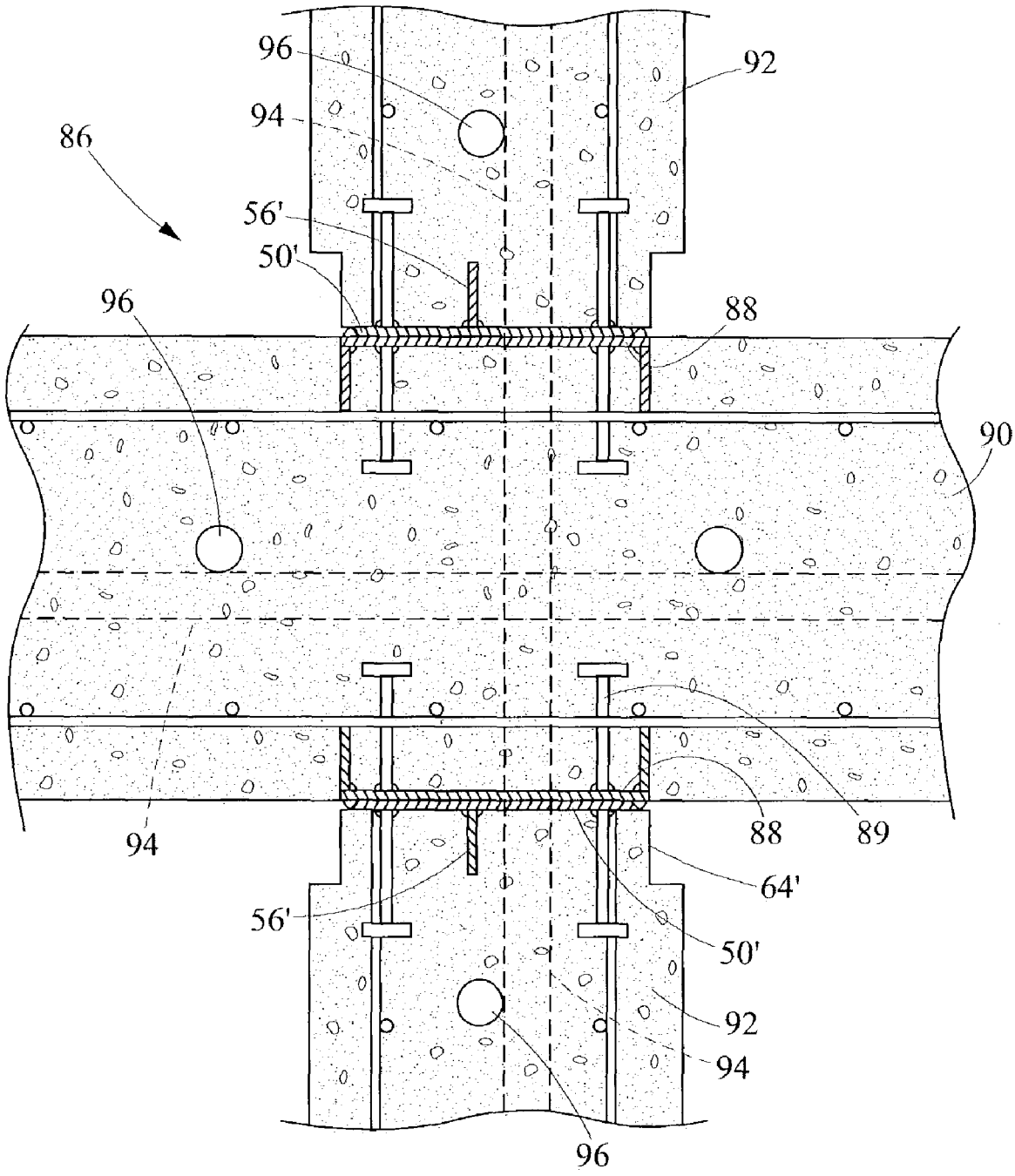
FIG. 5 is a cross-section of a wall/wall cross-connection in accordance with the present invention taken along lines 5—5—5—5 of FIG. 1.
Figure 6:
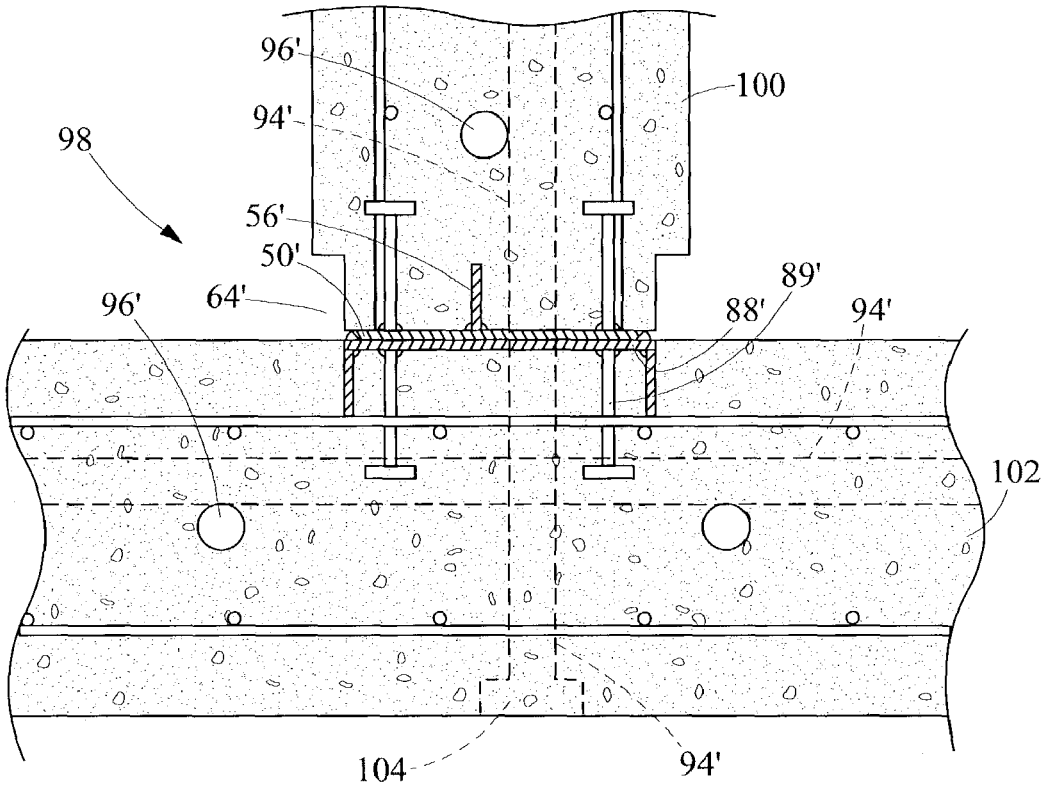
FIG. 6 is a cross-section of a wall/wall "T" connection in accordance with the present invention taken along lines 6—6—6 of FIG. 1.

A wall-to-wall cross connection 86 in accordance with the present invention is illustrated in FIG. 5. In such a connection, two continuous channels 88 including headed anchor studs 89 are embedded opposite each other in a preformed panel 90 which is constructed in a similar manner as the preformed concrete side panels 28 discussed above. Two other panels 92 would be formed with side steel plates 50' in the same manner the side steel plates 50 are embedded in the concrete side panels 28 as discussed above. The side steel plates 50 in the two panels 92 would be aligned with and connected to the two channels 88 in the single panel 90 by welding. Lengthwise voids 64' for receiving a protective grout are defined adjacent the side steel plates 50' in the same manner discussed above with respect to the lengthwise voids 64. In addition, aligned horizontal post-tensioning sleeves 94 may be provided as needed for additional structural support, as may vertical post-tensioning sleeves 96. The water stops 56' may be provided where the connections are intended to be watertight or may be omitted where the connections do not need to be watertight.

A wall-to-wall T-connection 98 is shown in a cross-section taken along line 6—6—6 of FIG. 1. In this connection the interior wall panel 100 is configured with an edge plate 50', water stops 56', voids 64', horizontal post-tensioning sleeves 94' and vertical post-tensioning sleeves 96' identical to the two panels 92 described above with respect to FIG. 5. Likewise, the exterior wall 102 features a continuous steel channel 88', headed anchor studs 89', and horizontal and vertical post-tensioning sleeves 94', 96' virtually identical to those provided in the single wall 90 discussed above. One exception is the horizontal post-tensioning sleeves 94' in the exterior wall will include a counter sink 104 for anchoring horizontal post-tensioning tendons.

Figure 7A:
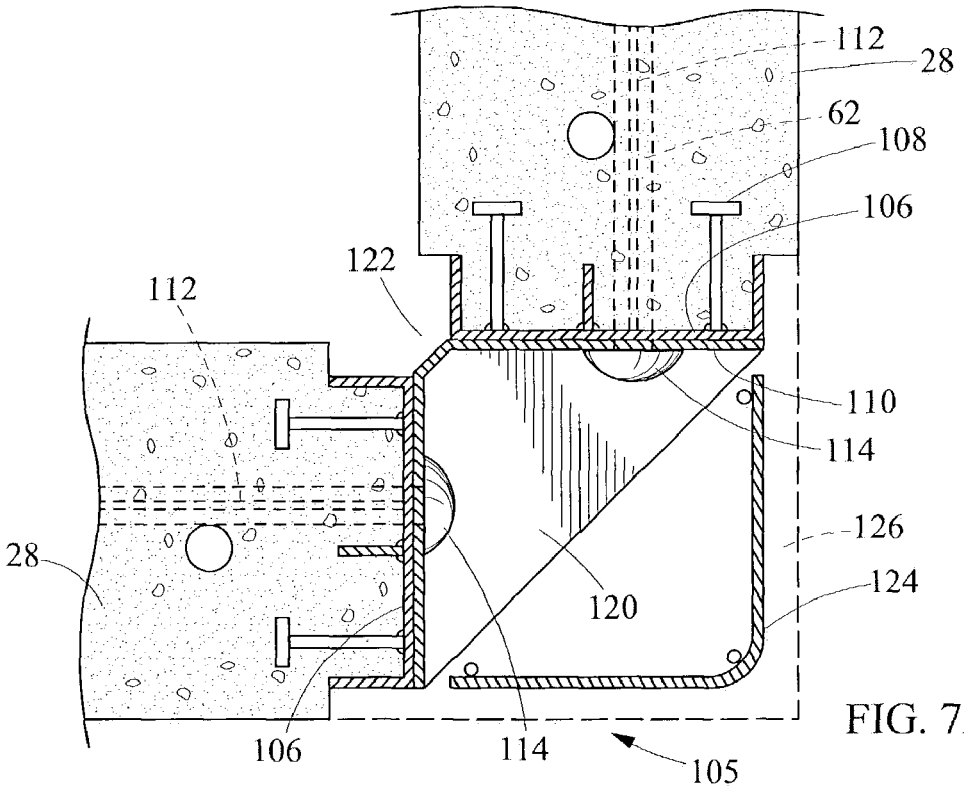
FIG. 7A is a cross-section of a corner connection taken along line 7—7 of FIG. 2.
Figure 7B:
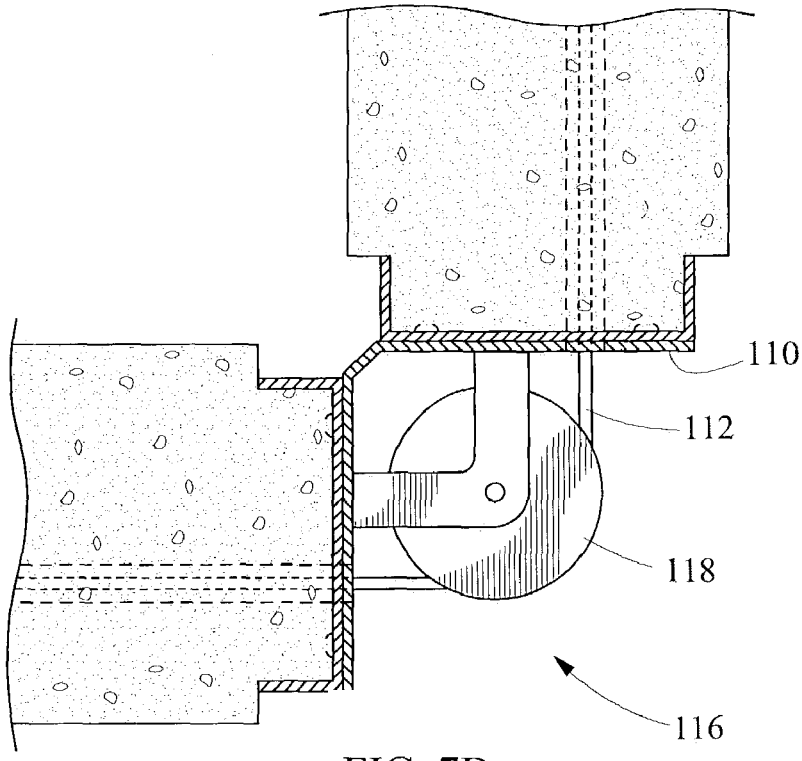
FIG. 7B is a cross-section of an alternate embodiment of a corner connection of FIG. 7A.

FIG. 7A shows a corner connection 105 in a cross-section taken along line 7—7 of FIG. 2. The corner connection is formed by an L-shaped continuous steel corner brace 110 which is welded to modified side steel plates 106. The modified side steel plates 106 may be steel channels as shown in FIG. 7 embedded within the side panels 28 by headed anchor studs 108. Alternatively, the modified steel plates may be flat plates identical to 50 as described in FIG. 4. The modified side steel plates 106 and the L-shaped continuous steel corner brace 110 have holes aligned with the horizontal post-tensioning sleeves 62 for receiving a post-tensioning tendon 112, which preferably is a steel cable. Post-tensioning anchors 114 may be provided at each L-shaped continuous steel corner brace for post-tensioning of the tank sides. In an alternative embodiment, one or more of the corners may be provided with pulleys 116 including sheaves 118 which direct post-tensioning cable 112 around the L-shaped continuous steel corner brace as illustrated in FIG. 7B. In such an embodiment, preferably three corners would have the pulley so that only one corner need include the anchors 114. In a preferred embodiment, a diagonal gusset plate 120 may be provided between distal ends of each leg of the L-shaped continuous steel corner brace for additional rigidity. As seen in FIG. 7A, an interior corner void 122 is formed along the interior corner for receiving a protective grout. Bent reinforcing 124 may be provided between the distal ends of the L-shaped continuous steel corner brace for reinforcing an exterior concrete layer 126 after welding of the corner members. The modified steel side plates are preferably welded to the L-shaped continuous steel corner brace using four continuous water-tight welds. Horizontal post-tensioning gives rise to friction between the plates 106 and the L-shaped continuous steel corner brace 110 which structurally supports the tank corner 105.

Figure 8:
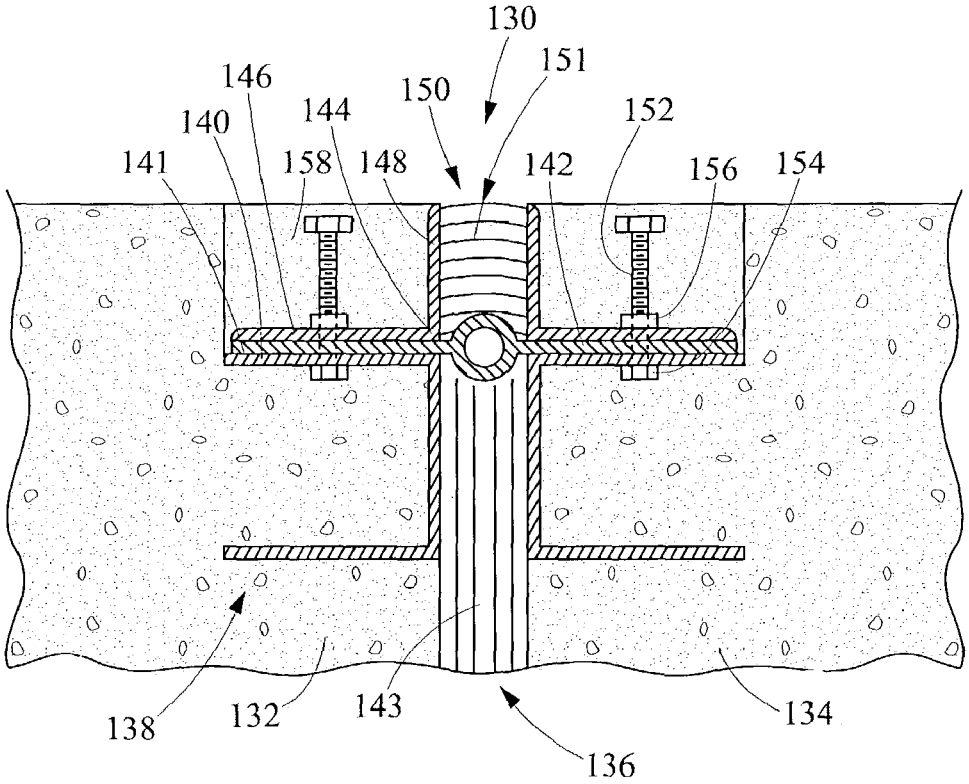
FIG. 8 is a cross section of a slab expansion joint taken along line 8—8 of FIG. 2.

Concrete panels (which are intended to include vertical sidewall panels and horizontal slab segments) sometimes require expansion joints to allow for expansion of the concrete with temperature changes. Special details provide for such expansion joints in the present invention. Referring to FIG. 2, a slab expansion joint 130 further illustrated in FIG. 8 maybe employed. The expansion joint 130 consists of a first slab segment 132 and a second slab segment 134 separated by a space 136. During formation of the slab segments 132, 134, U-shaped steel channels 138 are embedded in the concrete lengthwise of the slab segments on opposite sides of the space 136. A leg 140 of each U-shaped channel has an unembedded surface 141 and the unembedded surface of opposing channels 138 are essentially coplanar. A sheet of flexible vinyl water stop 142 extends between the unembedded surfaces 141 of the legs 140 and bridges the space 136. "Essentially coplanar" means the surfaces align so that the vinyl water stop can provide an effective water barrier. A preformed joint filler 143 lies below the vinyl water stop 142 in the space 136. The preformed joint filler is a commercially available compressible material suitable for creating a void space between poured concrete members. A clamp secures the vinyl water stop 142 to each unembedded surface of the U-shaped channels. The clamp consists of an L-shaped steel bracket 144 having a first leg 146 abutting a surface of the water stop opposite the unembedded surface 141 and a second leg 148 extending from the first leg away from the unembedded surface 141 and parallel to a second leg 148 of the complimentary L-shaped steel bracket 144 to define a volume 150 between the extending second legs 148 filled with flexible sealant 151. Carriage bolts 152 engage complimentary nuts 154, 156 which function with the first leg 146 and the unembedded leg 140 to clamp the water stop 142 in place. The lengthwise voids 158 are filled with a suitable non-shrink grout. As illustrated in FIG. 8, preferably the second leg of each L-shaped steel bracket extends a distance about equal to a select depth of the lengthwise void 158 to enable formation of a substantially flat top surface of the expansion joint 130.

The expansion joint 130 is formed during slab formation. The first slab segment 132 is poured including an embedded U-Shaped Channel 138 with a wooden strip bolted to the unembedded leg to form the lengthwise void 158. The preformed joint filler 143 is fastened to the face of the first slab section and the second slab segment 134 is poured including an embedded U-shaped channel with a wooden strip bolted to the unembedded leg to form a second lengthwise void. Thereafter, the flexible vinyl water stop 142 is laid into position as illustrated in FIG. 8 and the L-shaped steel brackets are put in place as described above and clamped down using the carriage bolts 152 and nuts 154, 156. Next, flexible sealant 151 is installed in the void 150 followed by placement of a non-shrink grout in the lengthwise voids 158.

Figure 9:
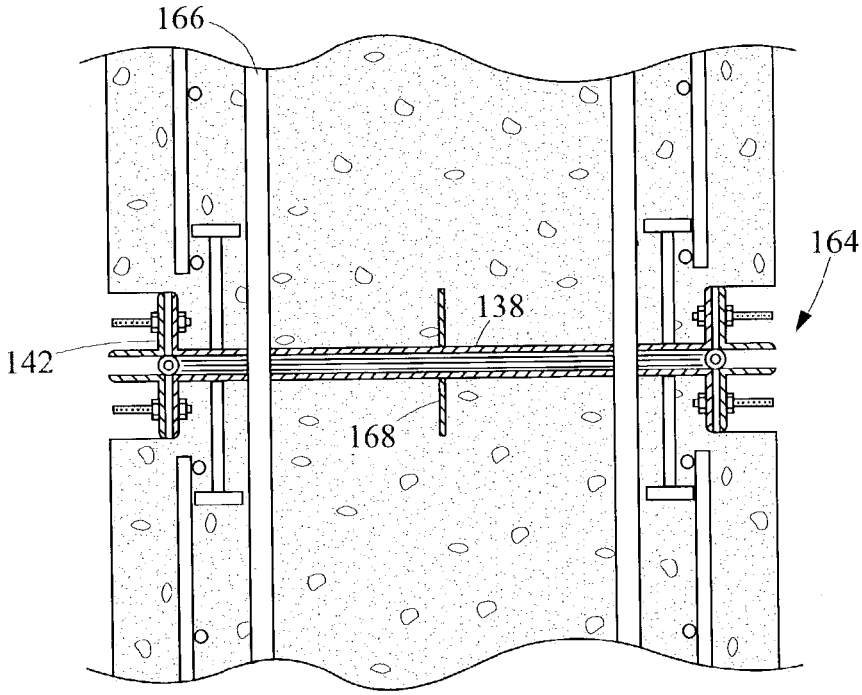
FIG. 9 is a cross-section of a wall expansion joint taken along line 9—9 of FIG. 2.

Wall expansion joints may also be necessary. A wall expansion joint 164 is illustrated in FIG. 9. The wall expansion joint 164 is similar in construction to the slab expansion joint 130 except the clamp structure including the flexible vinyl water stop 142 is provided on each side of the wall. Due to the similarity of the structure, the same reference numbers are used with the slab expansion joint 130 and description of these elements is not repeated. One difference between the wall expansion joint 164 and the slab expansion joint 130 is that each U-shaped channel 138 extend a length along the face of the wall panel such that both of the smaller legs of the channel are not fully embedded in the concrete and thereby serve as seating surfaces for the vinyl waterstop. In addition, steel water stops 168 extend into the concrete from the channels 138. A second difference between the wall expansion joint 164 and the slab expansion joint 130 is the use of shear dowels 166 across the wall expansion joint 164 to withstand shear stresses across the expansion Joint 164 and to maintain the structural integrity of the expansion joint 164 under loads.

As illustrated in FIG. 2, the slab expansion joint 130 and the wall expansion joint 164 are preferably aligned. To ensure the integrity of the water barrier, an L-shaped piece of vinyl waterstop and L-shaped clamping brackets preferably extends between the slab expansion joint 130 and the wall expansion joint 164.

Figure 10:
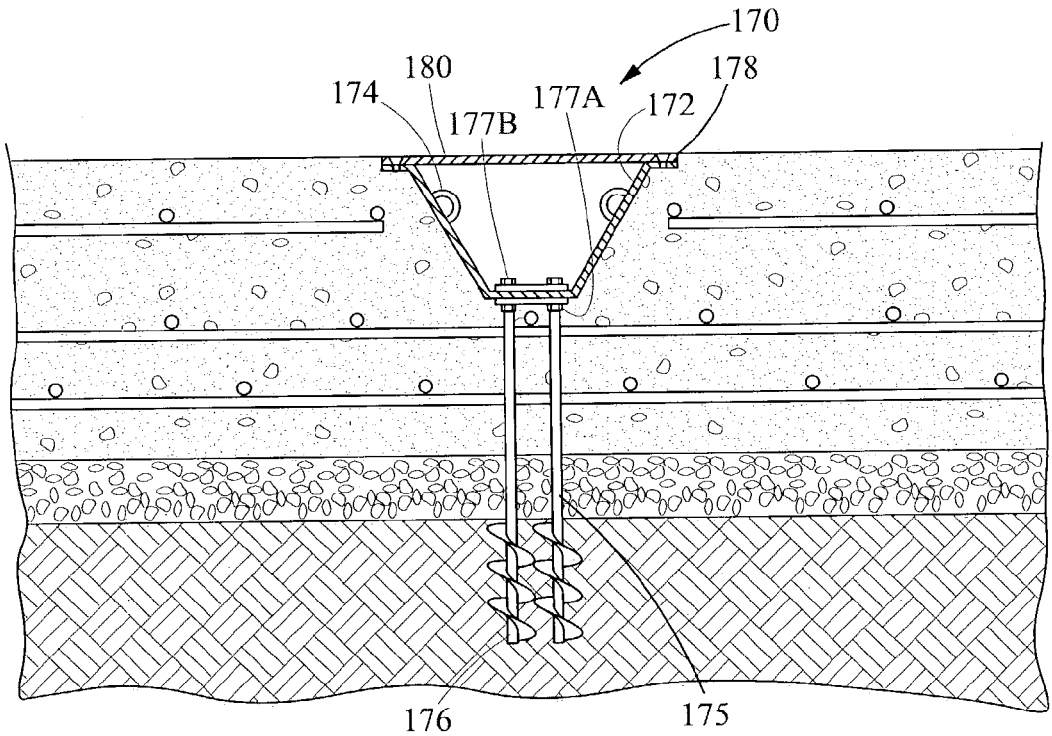
FIG. 10 is a cross-section of a "V" drain trough taken along line 10—10 of FIG. 2.

To facilitate wash down and cleanup of the basin, drain channels 170 may be installed in the slab along with placement of the reinforcing. Drain channels 170 may be preferred over sloping floors and drain sumps to ensure flat surfaces are maintained on the slab for construction of the wall panels. An illustrative drain channel 170 is shown in FIG. 2 and the formation of the drain channel 170 is explained with reference to a cross-section of the drain channel in FIG. 10. A V-shaped form 172 defines the drain channel during pouring of the concrete. The V-shaped form 172 has an elongate flat bottom and diverging side walls and extends the length of the drain channel 170. Eye lifts 174 are attached to an interior of the side walls to facilitate removal of the V-shaped form from the drain channel after concrete curing. Holes are spaced lengthwise in the bottom of the V-shaped form and are configured to receive rods 175, which are preferably threaded and which extend from ground anchors 176. Bottom nuts 177A threadably receive the threaded rod to support the form 172 a select distance above the ground. Top nuts 177B cooperate with the bottom nuts 177A to clamp the form 172 therebetween. As should be apparent, the rods 175 need not be threaded and other stays besides nuts could be used to secure the form in place during pouring of the slab. Preferably the V-shaped form 172 includes a top flange 178 on each side wall which defines a shelf for receiving an elongate cover plate 180 which is essentially flush with the surface of the slab 12. The cover plate may be installed temporarily to accommodate traffic over the drain channel 170 or the pouring of concrete side panels 28 on the slab surface. The V-shaped form 172 can be removed once construction of the tank is complete and may be reused for construction of other tanks.

Figure 11:
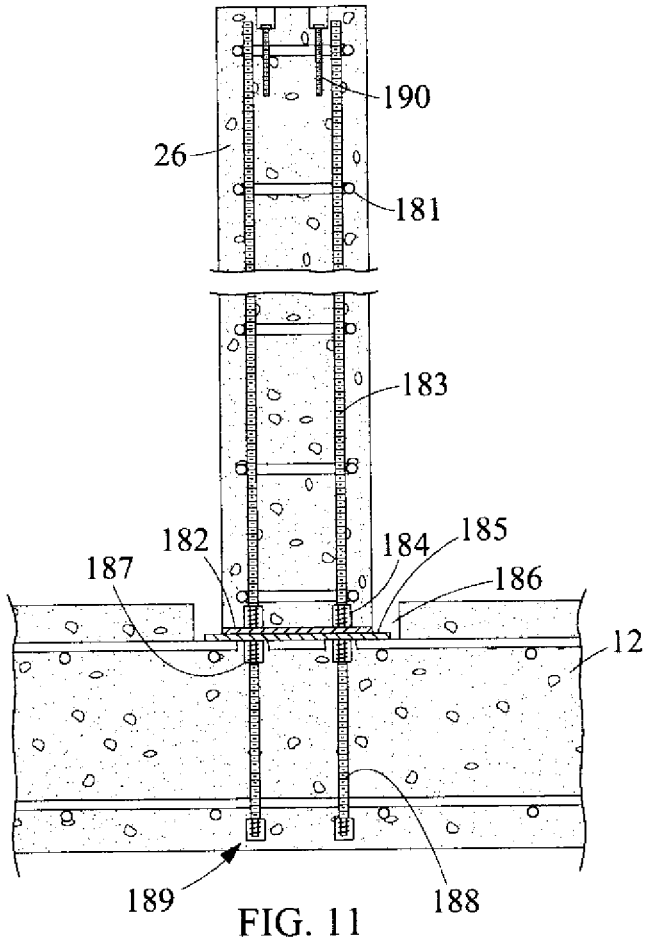
FIG. 11 is a cross-section of a concrete column assembly taken along line 11—11 of FIG. 2.

In some circumstances it may be desirable to provide columns 26 in the tank interior for support of a roof or other items. Referring to FIG. 11, each column 26 includes steel reinforcing 181 and a steel bottom plate 182. Vertical reinforcing 183 is preferably threaded and mates with a threaded half-coupling 184 that is welded to the steel bottom plate 182. A steel plate 185 is embedded in the surface of the slab 12 preferably within a recess 186. Threaded half-couplings 187 are welded to the steel bottom plate 185 and threaded vertical reinforcing 188 is mated to the half couplings 187. The threaded reinforcing 188 terminates near the bottom of the slab with a threaded end to which a threaded terminating nut 189 is mated to serve as additional anchorage for the column. The plates 182, 185 are welded together to secure the column 26 in place. Afterwards the recess 186 is filled with grout to protect the weld and exposed steel surfaces from corrosion. In the top of the column lifting lug anchors 190 may be provided to facilitate tilt-up and placement of the columns 26.

Figure 12:
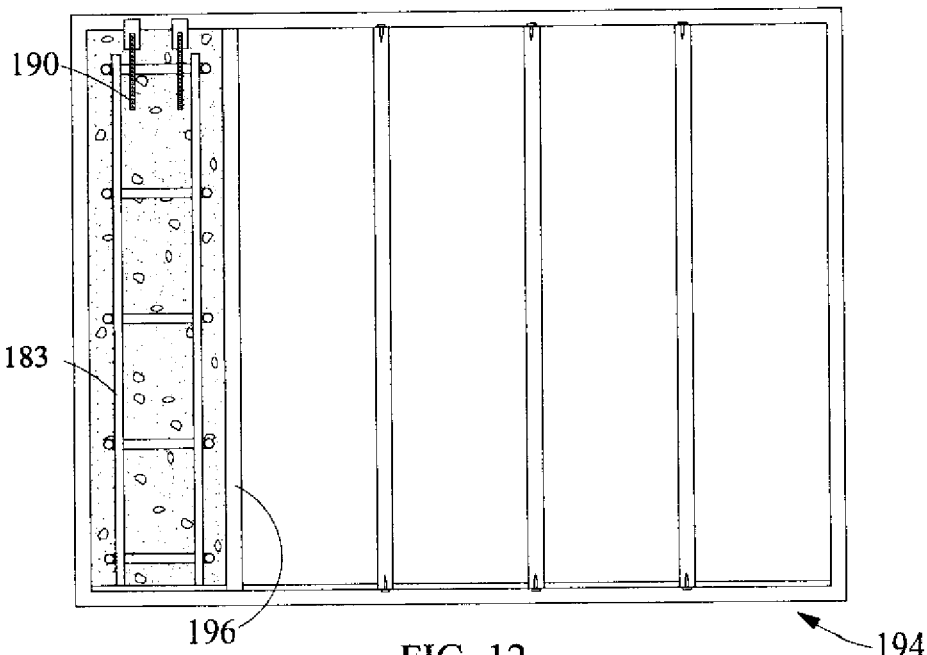
FIG. 12 is a plan view of formwork for casting multiple columns in accordance with the present invention.

Form work for casting the columns 26 is illustrated in FIG. 12. The form 194 may be made of wood or steel. Column dividers 196 are provided to define each column and the reinforcing 180 is disposed within each bay along with the lifting lug anchors 190 as shown. The form 194 permits the quick and inexpensive onsite formation of the columns 26.

Construction of the rectangular tilt-up concrete tank in accordance with the present invention requires three distinct welding tasks. The first is the extensive welding necessary for the wall panel erection. The second involves fabrication of the slab/wall connection plates and channels including the integral steel waterstops. The third involves miscellaneous field welding of the channels and plate joints, interior corners of the wall panels, etc. While the field welding will need to be done by individual welders, automated or semi-automatic welding equipment may be used in the welding for erection of the wall panels and for fabrication of the channels and flat plates.

Fabrication of the channels and plates including the welding, cutting of holes, etc., may be done onsite or could be prefabricated offsite. If they are to be fabricated onsite, a covered trailer-mounted welding/cutting shop may be utilized to process pieces in an assembly-line fashion.

The preferred embodiment described herein shows a single layer of concrete side panels 28. However, where deeper concrete structures such as pipe galleries, filters or pump stations are required, it may be feasible to stack the wall panels. Stacking of side panels may allow the formation of deep tanks with thick walls without exceeding the practical lift weights of conventional cranes.

What is claimed is:

1. A rectangular concrete tank comprising:

a concrete slab having a slab steel plate anchored thereto, the slab steel plate defining four substantially linear concrete side wall location of a rectangular tank outline; and at least four preformed concrete side panels each having metal plates attached along a bottom edge and along opposing side edges, the bottom edge plates being welded in a liquid-tight weld to the slab metal plate defining the concrete side wall locations and each side metal plate of each side panel being connected to a side metal plate of an adjacent side panel by a connection including a liquid-tight weld to define four rectangular tank side walls.

2. The rectangular tilt-up tank of claim 1 further comprising:

an L-shaped continuous metal corner brace between adjacent side metal plates of adjacent tank sides, with a leg of the L-shaped continuous metal corner brace abutting the adjacent side metal plates, the adjacent side metal plates being welded in a liquid-tight weld to the abutting leg of the L-shaped continuous metal corner brace to define a liquid-tight rectangular tank corner.

3. The rectangular tilt-up tank of claim 2 wherein the L-shaped continuous metal corner brace includes a diagonal gusset plate extending between a distal end of each leg of the L-shaped continuous metal corner brace.

4. The rectangular tilt-up tank of claim 2 further comprising a plurality of vertically spaced horizontal post-tensioning sleeves within each preformed concrete side panel configured to define a plurality of continuous horizontal post-tensioning sleeves with adjacent side panels, the continuous post-tensioning channels receiving post-tensioned tendons, the post-tensioned tendons being anchored at the L-shaped continuous metal corner braces adjacent each tank side comprised of the side panels.

5. The rectangular tilt-up tank of claim 2 further comprising:

a plurality of vertically spaced horizontal post-tensioning sleeves within each preformed concrete side panel configured to define a plurality of continuous horizontal post-tensioning sleeves with adjacent side panels, the continuous post-tensioning channels receiving post-tensioned tendons; and a pulley attached to an L-shaped continuous metal corner brace between a pair of adjacent tank sides with a sheave of the pulley receiving the post-tensioned cable to direct the cable between aligned continuous post-tensioning channels of adjacent tank sides.

6. The rectangular tilt-up tank of claim 1 further comprising a plurality of vertically spaced horizontal post-tensioning sleeves within each preformed concrete side panel configured to define a plurality of continuous horizontal post-tensioning sleeves with adjacent side panels, the continuous post-tensioning sleeves receiving post-tensioned tendons.

7. The rectangular tilt-up tank of claim 6 further comprising a plurality of horizontally spaced vertical post-tensioning sleeves within each preformed concrete side panel and a corresponding vertical post-tensioning anchor embedded in the slab aligned with each vertical post-tensioning sleeve, each vertical post-tensioning sleeve receiving a vertical post-tensioned tendon attached to a corresponding vertical post-tensioning anchor.

8. The rectangular tilt-up tank of claim 1 further comprising a plurality of horizontally spaced vertical post-tensioning sleeves within each preformed concrete side panel and a corresponding vertical post-tensioning anchor embedded in the slab aligned with each vertical post-tensioning sleeve, each vertical post-tensioning sleeve receiving a vertical post-tensioned tendon attached to a corresponding vertical post-tensioning anchor.

9. The rectangular tilt-up tank of claim 1 wherein each slab metal plate has a top surface substantially coplanar with a top surface of the concrete slab.

10. The rectangular tilt-up tank of claim 1 wherein the slab metal plates anchored in the concrete slab comprise a bottom plate of a U-shaped channel.

11. The rectangular tilt-up tank of claim 10 further comprising a plurality of headed anchor studs having a headed end embedded in the concrete and a second end attached to the U-shaped channel.

12. The rectangular tilt-up tank of claim 1 wherein each of the performed concrete side panels has a lengthwise void adjacent the metal plate along bottom edge for receiving a protective grout.

13. The rectangular tilt-up tank of claim 1 wherein the side metal plates of each side panel do not extend the entire width of the side edges, so that with adjacent side metal panels in abutment a lengthwise grout receptacle is defined.

* * * * *